US006495228B1

(12) United States Patent
Mauch et al.

(10) Patent No.: US 6,495,228 B1
(45) Date of Patent: Dec. 17, 2002

(54) SELF ADHESIVE WRAPPING MATERIAL

(76) Inventors: Jennifer Mauch, 5426 W. Westshore Dr., Mc Henry, IL (US) 60050; Robert J. Mauch, 5426 W. Westshore Dr., Mc Henry, IL (US) 60050

( * ) Notice: Subject to any disclaimer, the term of this patent is extended or adjusted under 35 U.S.C. 154(b) by 178 days.

(21) Appl. No.: 09/612,107

(22) Filed: Jul. 7, 2000

(51) Int. Cl.[7] ..... B65D 65/14

(52) U.S. Cl. ..... 428/40.1; 229/87.01; 229/87.18; 229/87.19; 229/923; 428/42.1; 428/192; 428/194; 428/195; 428/201; 428/202; 428/906

(58) Field of Search ..... 428/40.1, 42.1, 428/192, 194, 906, 201, 202, 195; 229/87.19, 923, 87.18, 87.01

(56) References Cited

U.S. PATENT DOCUMENTS 2,676,897 A 4/1954 Trillich
D272,103 S 1/1984 Richards
4,552,802 A * 11/1985 Mechin ..... 428/255
4,863,537 A 9/1989 Sadri
5,306,372 A 4/1994 Hall et al.
5,337,943 A 8/1994 Hendren
5,414,976 A 5/1995 Richards

* cited by examiner

*Primary Examiner*—Nasser Ahmad

(57) ABSTRACT

A self adhesive wrapping material for wrapping an object without the need for tape or other adhesive material. The self adhesive wrapping material includes a panel. The panel has a top surface and a bottom surface. The panel comprises a generally flexible material. Each of a plurality of adhesive portions is securely adhered to the bottom surface of the panel. A plurality of covering members for removably attaches to and covers the adhesive portions. Each of the covering members generally covers one of the adhesive portions.

4 Claims, 6 Drawing Sheets

SELF ADHESIVE WRAPPING MATERIAL

BACKGROUND OF THE INVENTION

1. Field of the Invention

The present invention relates to wrapping paper and more particularly pertains to a new self adhesive wrapping material for wrapping an object without the need for tape or other adhesive material.

2. Description of the Prior Art

The use of wrapping paper is known in the prior art. More specifically, wrapping paper heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,306,372; 2,676,897; 5,414,976; 4,863,537; 5,337,943; and Des. U.S. Pat. No. 272,103.

While these devices fulfill their respective, particular objectives and requirements, the aforementioned patents do not disclose a new self adhesive wrapping material. The inventive device includes a panel. The panel has a top surface and a bottom surface. The panel comprises a generally flexible material. Each of a plurality of adhesive portions is securely adhered to the bottom surface of the panel. A plurality of covering members for removably attaches to and covers the adhesive portions. Each of the covering members generally covers one of the adhesive portions.

In these respects, the self adhesive wrapping material according to the present invention substantially departs from the conventional concepts and designs of the prior art, and in so doing provides an apparatus primarily developed for the purpose of wrapping an object without the need for tape or other adhesive material.

SUMMARY OF THE INVENTION

In view of the foregoing disadvantages inherent in the known types of wrapping paper now present in the prior art, the present invention provides a new self adhesive wrapping material construction wherein the same can be utilized for wrapping an object without the need for tape or other adhesive material.

The general purpose of the present invention, which will be described subsequently in greater detail, is to provide a new self adhesive wrapping material apparatus and method which has many of the advantages of the wrapping paper mentioned heretofore and many novel features that result in a new self adhesive wrapping material which is not anticipated, rendered obvious, suggested, or even implied by any of the prior art wrapping paper, either alone or in any combination thereof.

To attain this, the present invention generally comprises a panel. The panel has a top surface and a bottom surface. The panel comprises a generally flexible material. Each of a plurality of adhesive portions is securely adhered to the bottom surface of the panel. A plurality of covering members for removably attaches to and covers the adhesive portions. Each of the covering members generally covers one of the adhesive portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new self adhesive wrapping material apparatus and method which has many of the advantages of the wrapping paper mentioned heretofore and many novel features that result in a new self adhesive wrapping material which is not anticipated, rendered obvious, suggested, or even implied by any of the prior art wrapping paper, either alone or in any combination thereof.

It is another object of the present invention to provide a new self adhesive wrapping material which may be easily and efficiently manufactured and marketed.

It is a further object of the present invention to provide a new self adhesive wrapping material which is of a durable and reliable construction.

An even further object of the present invention is to provide a new self adhesive wrapping material which is susceptible of a low cost of manufacture with regard to both materials and labor, and which accordingly is then susceptible of low prices of sale to the consuming public, thereby making such self adhesive wrapping material economically available to the buying public.

Still yet another object of the present invention is to provide a new self adhesive wrapping material which provides in the apparatuses and methods of the prior art some of the advantages thereof, while simultaneously overcoming some of the disadvantages normally associated therewith.

Still another object of the present invention is to provide a new self adhesive wrapping material for wrapping an object without the need for tape or other adhesive material.

Yet another object of the present invention is to provide a new self adhesive wrapping material which includes a panel. The panel has a top surface and a bottom surface. The panel comprises a generally flexible material. Each of a plurality of adhesive portions is securely adhered to the bottom surface of the panel. A plurality of covering members for removably attaches to and covers the adhesive portions. Each of the covering members generally covers one of the adhesive portions.

Still yet another object of the present invention is to provide a new self adhesive wrapping material that prevents the need for the purchase of multiple items when wrapping a gift or other item.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
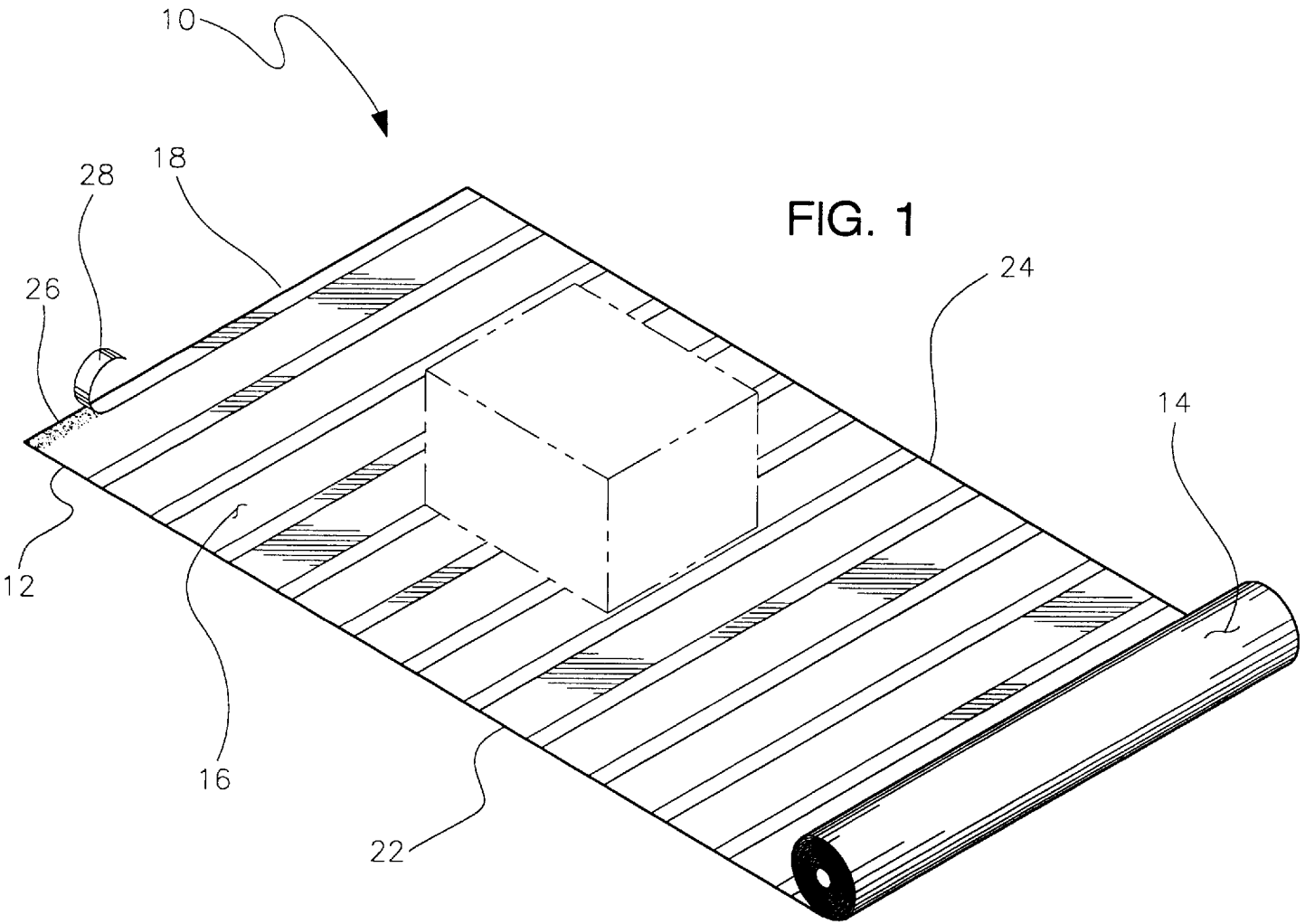
FIG. 1 is a schematic perspective view of a new self adhesive wrapping material according to the present invention.

With reference now to the drawings, and in particular to FIGS. 1 through 6 thereof, a new self adhesive wrapping material embodying the principles and concepts of the present invention and generally designated by the reference numeral 10 will be described.

Figure 4:
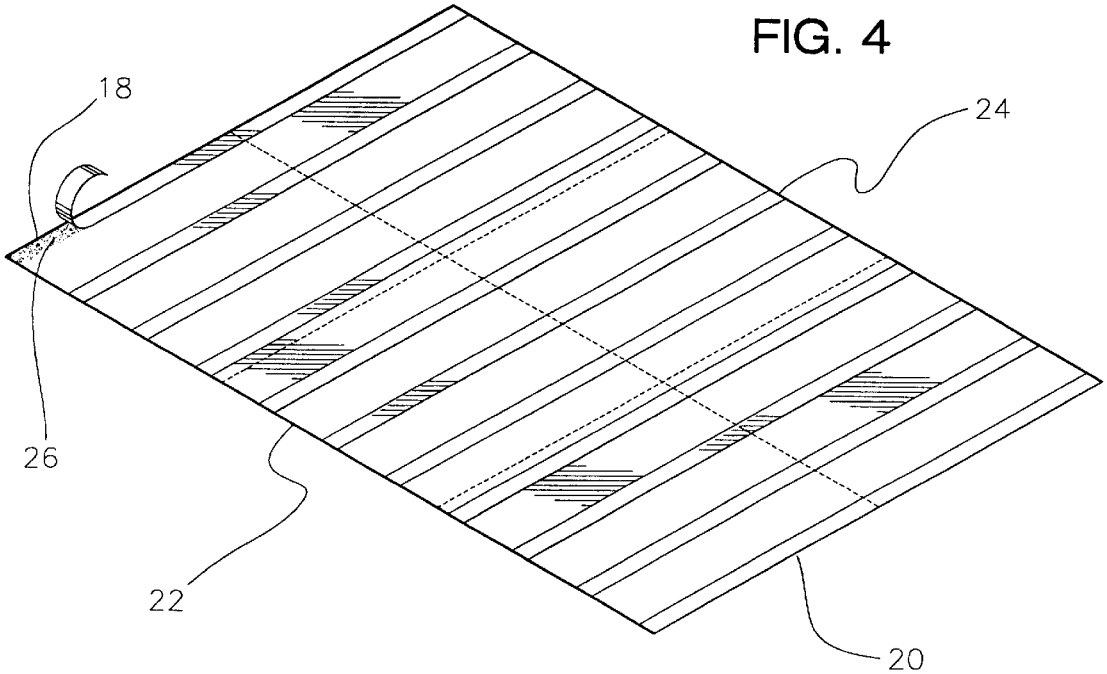
FIG. 4 is a schematic perspective view of a single sheet of the present invention.

As best illustrated in FIGS. 1 through 6, the self adhesive wrapping material 10 generally comprises a panel 12. The panel 12 is elongate, and has a top surface 14, a bottom surface 16, a first end 18, a second end 20, a first side edge 22 and a second side edge 24. The panel 12 has a generally rectangular shape, and comprises a generally flexible material. The flexible material preferably comprises a paper material. The panel 12 may be rolled as in FIGS. 1, 2, 5 and 6, or may be a folded sheet of paper as shown in FIG. 4.

Figure 2:
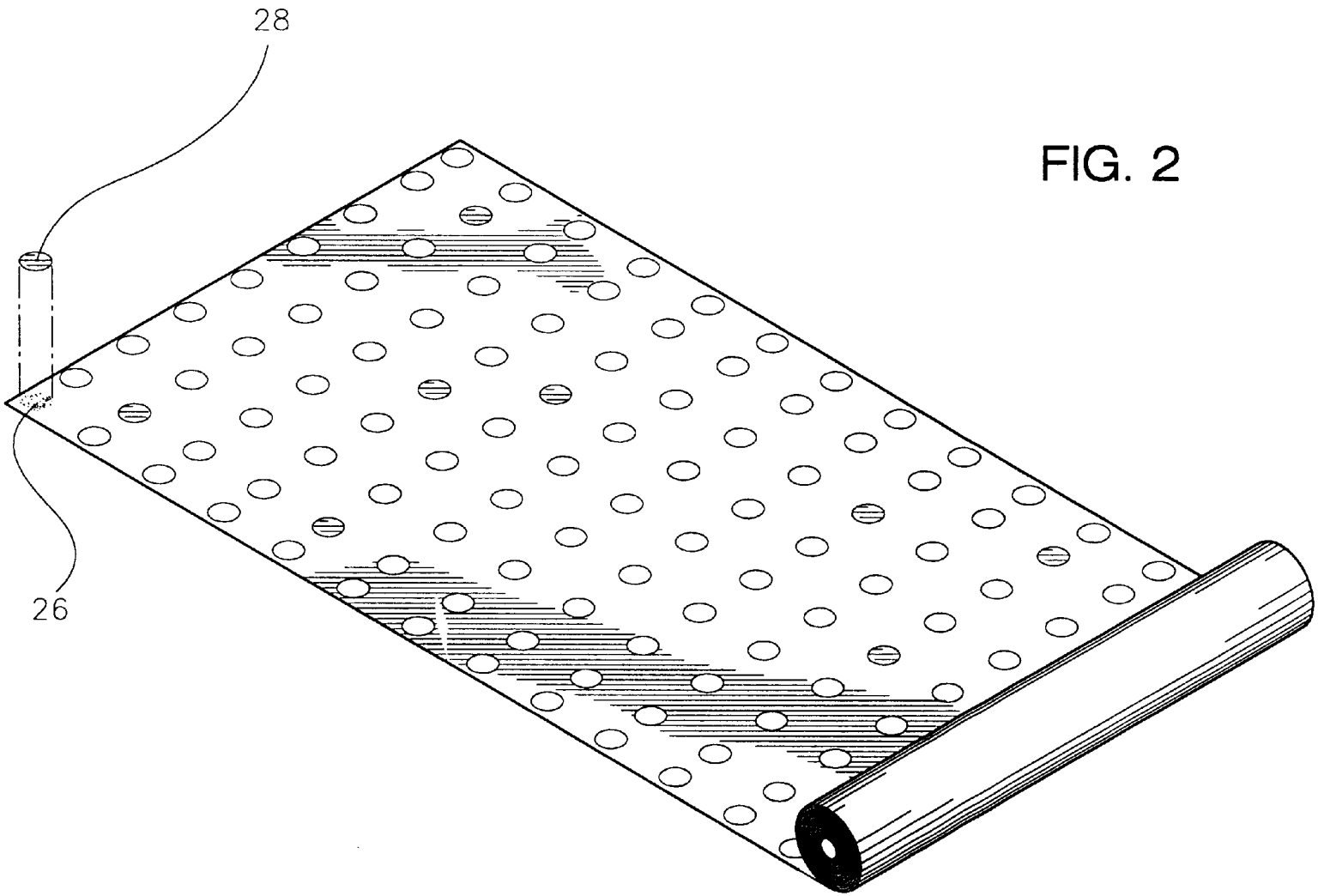
FIG. 2 is a schematic perspective view of the present invention.
Figure 3:
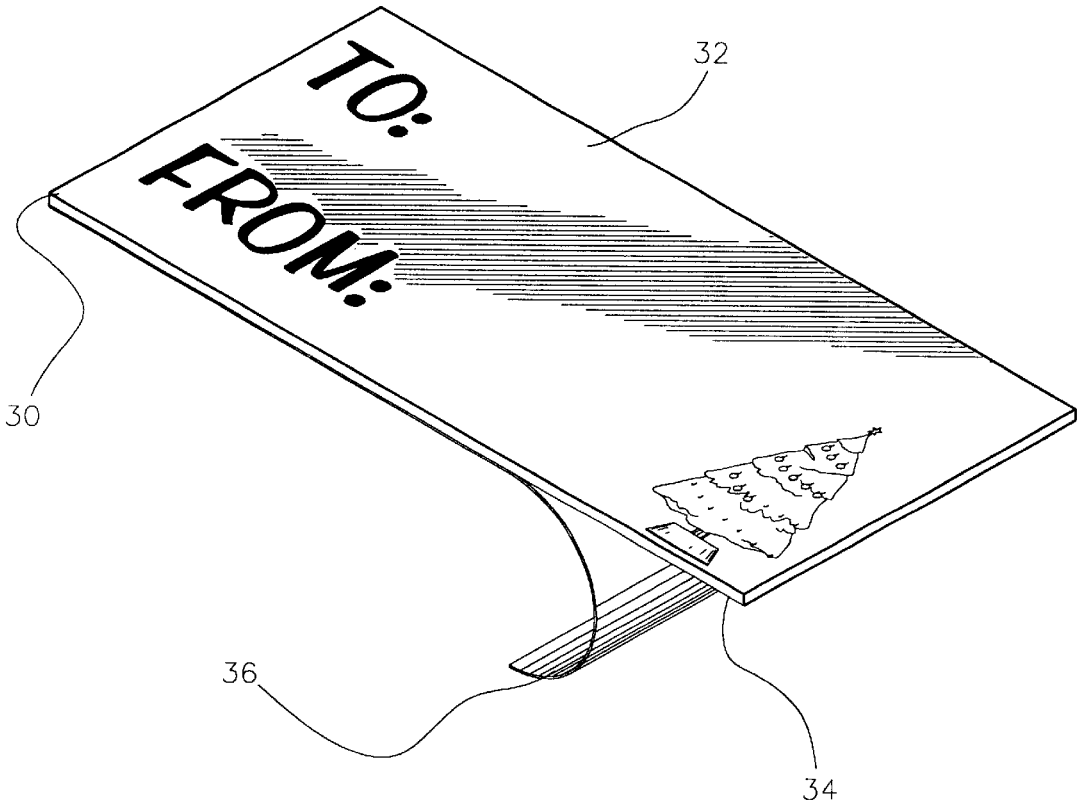
FIG. 3 is a schematic perspective view of the label of the present invention.
Figure 5:
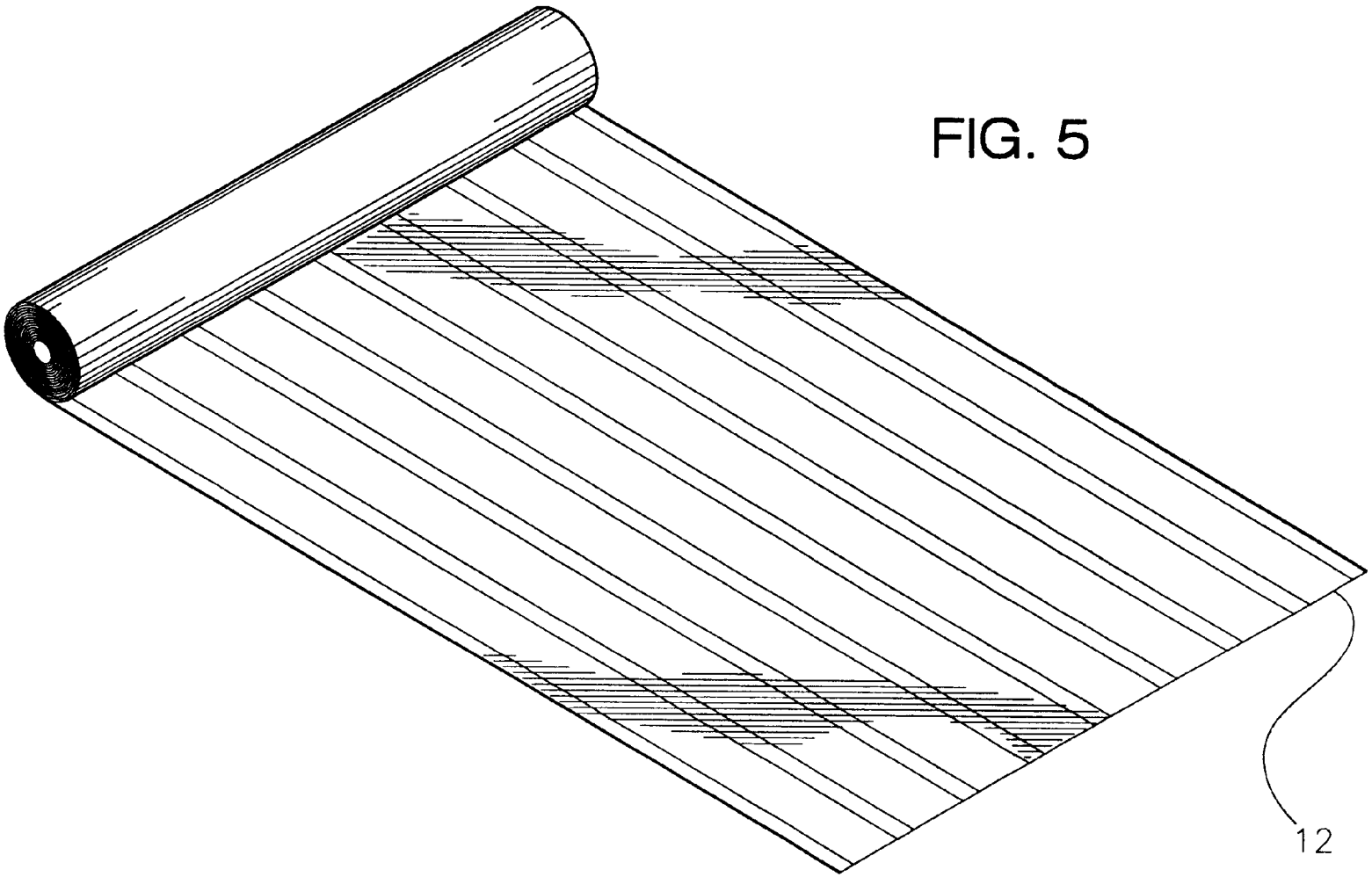
FIG. 5 is a schematic perspective view of the present invention.
Figure 6:
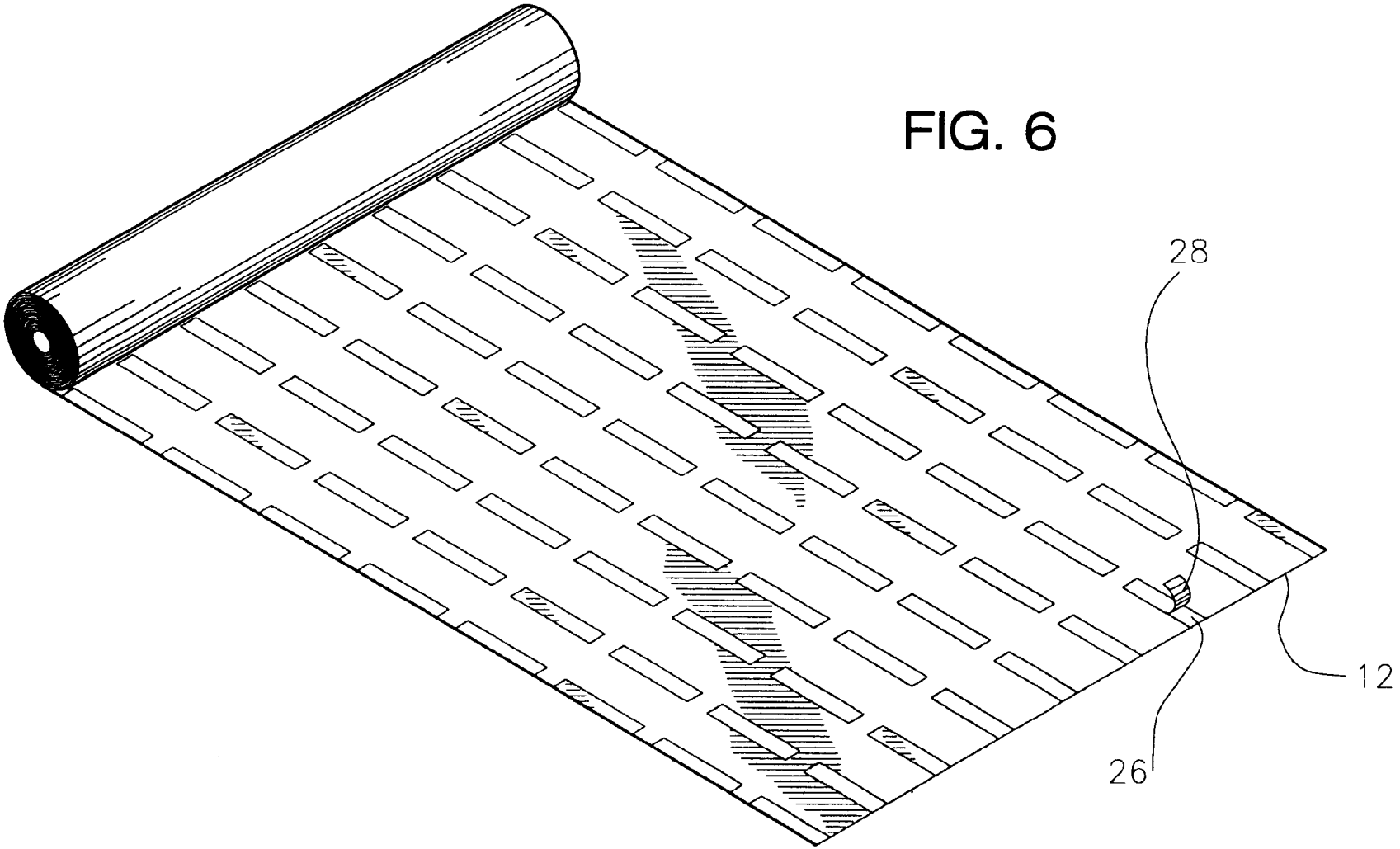
FIG. 6 is a schematic perspective view of the present invention.

Each of a plurality of adhesive portions 26 is securely adhered to the bottom surface 16 of the panel 12. Each of the adhesive portions 26 is spaced from each other. Each of the adhesive portions 26 preferably comprises a strip of adhesive material extending between the first 22 and second 24 side edges. The adhesive material 26 may also extend between the first 18 and second 20 ends as is shown in FIG. 5. The adhesive material 26 may also consist of discrete portions as shown in FIGS. 2 and 6. The adhesive material 26 is conventional adhesive material.

A plurality of covering members 28 removably attaches to the adhesive portions 26 and covers each of the adhesive portions. Each of the covering members 28 generally covers one of the adhesive portions 26. Each of the covering members has a shape and size substantially identical to a corresponding adhesive portion. The covering members 28 may be removed from the adhesive portions. The covering members 28 consist of conventional adhesive backing material.

A labeling means labels the panel. The labeling means comprises a sheet portion 30 having a front side 32 and a back side 34. The back side 34 of the sheet portion has an adhesive material thereon. An adhesive backing material 36 is on the adhesive material to cover and protect the adhesive material from unwanted adhesion. The sheet portion 30 preferably comprises a paper material.

In use, the panel 12 is used as conventional wrapping paper. The covering member 28 is removed to expose the adhesive material 26 such that the adhesive material be adhered to the panel so that tape is not needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. Self adhesive wrapping material, said material comprising:

a panel, said panel being elongate, said panel having a top surface, a bottom surface, a first end, a second end, a length extending between said first and second ends, a first side edge, a second side edge, and a width extending between said first and second side edges, said panel having a generally rectangular shape, said panel comprising a generally flexible material, said flexible material comprising a paper material, said length being longer than said width;

a plurality of elongated adhesive portions, each of said adhesive portions being securely adhered to said bottom surface of said panel, each of said adhesive portions being arranged in parallel spaced relationship to each other along said length of said panel, each of said adhesive portions comprising a strip of adhesive material extending fully along said width of said panel between said first and second side edges; and a plurality of covering members for removably attaching to said adhesive portions, each of said covering members generally covering one of said adhesive portion, each of said covering members having a shape and size substantially identical to a corresponding adhesive portion, wherein each of said covering members may be removed from said adhesive portions.

2. Self adhesive wrapping material, said material comprising:

a panel, said panel being elongate, said panel having a top surface, a bottom surface, a first end, a second end, a length extending between said first and second ends, a first side edge, a second side edge, and a width extending between said first and second side edges, said panel having a generally rectangular shape, said panel comprising a generally flexible material, said flexible material comprising a paper material;

a plurality of circular adhesive portions, each of said adhesive portions being securely adhered to said bottom surface of said panel, said adhesive portions being arranged into spaced lines of spaced adhesive portions extending along said length and said width of said panel forming a grid of adhesive portions on said back side of said panel; and a plurality of covering members for removably attaching to said adhesive portions, each of said covering members generally covering one of said adhesive portion, each of said covering members having a shape and size substantially identical to a corresponding adhesive portion, wherein each of said covering members may be removed from said adhesive portions.

3. The self adhesive wrapping material as in claim 1, further comprising:

a labeling means for labeling said panel, said labeling means comprising a sheet portion, said sheet portion having a front side and a back side, said back side having an adhesive material thereon securing said labeling means to said top surface of said panel, said sheet portion comprising a paper material.

4. The self adhesive wrapping material as in claim 2, further comprising:

a labeling means for labeling said panel, said labeling means comprising a sheet portion, said sheet portion having a front side and a back side, said back side having an adhesive material thereon securing said labeling means to said top surface of said panel, said sheet portion comprising a paper material.

* * * * *